United States Patent [19]

Trevino-Gonzalez

[11] Patent Number: 4,772,439

[45] Date of Patent: Sep. 20, 1988

[54] PROCESS OF QUICKLY MANUFACTURING CRITICALLY SHAPED CONCRETE PRODUCTS OF HIGH STRENGTH

[76] Inventor: Francisco Trevino-Gonzalez, Ave. Junco de la Vega 208, Colonia Roma, Monterrey, N.L., Mexico

[21] Appl. No.: 444,527

[22] Filed: Nov. 26, 1982

Related U.S. Application Data

[63] Continuation-in-part of Ser. No. 275,199, Jun. 19, 1981, abandoned.

[51] Int. Cl.[4] ..... F26B 21/08; F26B 21/10; F26B 21/14

[52] U.S. Cl. ..... 264/40.6; 264/40.1; 264/82; 264/333; 264/DIG. 43; 34/26; 34/32; 34/46; 34/50; 34/219

[58] Field of Search ..... 264/82, 40.1, 40.6, 264/DIG. 43, 333, 232, 340, 236, 347; 34/26, 32, 46, 50, 219

[56] References Cited

U.S. PATENT DOCUMENTS

| | | | |
|---|---|---|---|
| 2,496,895 | 2/1950 | Staley | 264/82 |
| 3,047,908 | 8/1962 | Lundgren et al. | 264/DIG. 43 B |
| 3,191,250 | 6/1965 | Mellen, Jr. et al. | 34/50 |
| 3,578,299 | 5/1971 | Hurlbut | 34/46 |
| 3,614,074 | 10/1971 | Wellford, Jr. | 34/46 |
| 4,067,939 | 1/1978 | Lowe et al. | 264/DIG. 43 |
| 4,099,337 | 7/1978 | Wauhop, Jr. | 34/26 |
| 4,102,962 | 7/1978 | Matsui et al. | 264/82 |
| 4,117,059 | 9/1978 | Murray | 264/333 |
| 4,144,086 | 3/1979 | Helgesson | 264/333 |
| 4,338,135 | 7/1982 | Cook | 264/DIG. 43 |

OTHER PUBLICATIONS

"Concrete Products"; Oct. 1981, pg. 72.
"Concrete", Aug. '82, pp. 33–35.

*Primary Examiner*—Jan H. Silbaugh
*Assistant Examiner*—Hubert C. Lorin
*Attorney, Agent, or Firm*—Laurence R. Brown

[57] ABSTRACT

A fast-cure process of manufacturing concrete products of critical shapes and strength requirements such as block, tile and pipe provides substantially maximum strength in a few hours as compared with the many months it would take in an ambient atmosphere. Critical shape is maintained without cracks, etc., by control of temperature, humidity and atmospheric $CO_2$ within a kiln in which the uncured concrete products reside. The humidity is kept at saturation until substantially all the concrete reacts chemically with the water. The temperature is controlled to prevent excessive temperatures at critical times and to accelerate cure when the products can stand higher temperatures. Free hydrated lime is fast cured by a $CO_2$ rich atmosphere at elevated temperature.

1 Claim, 1 Drawing Sheet

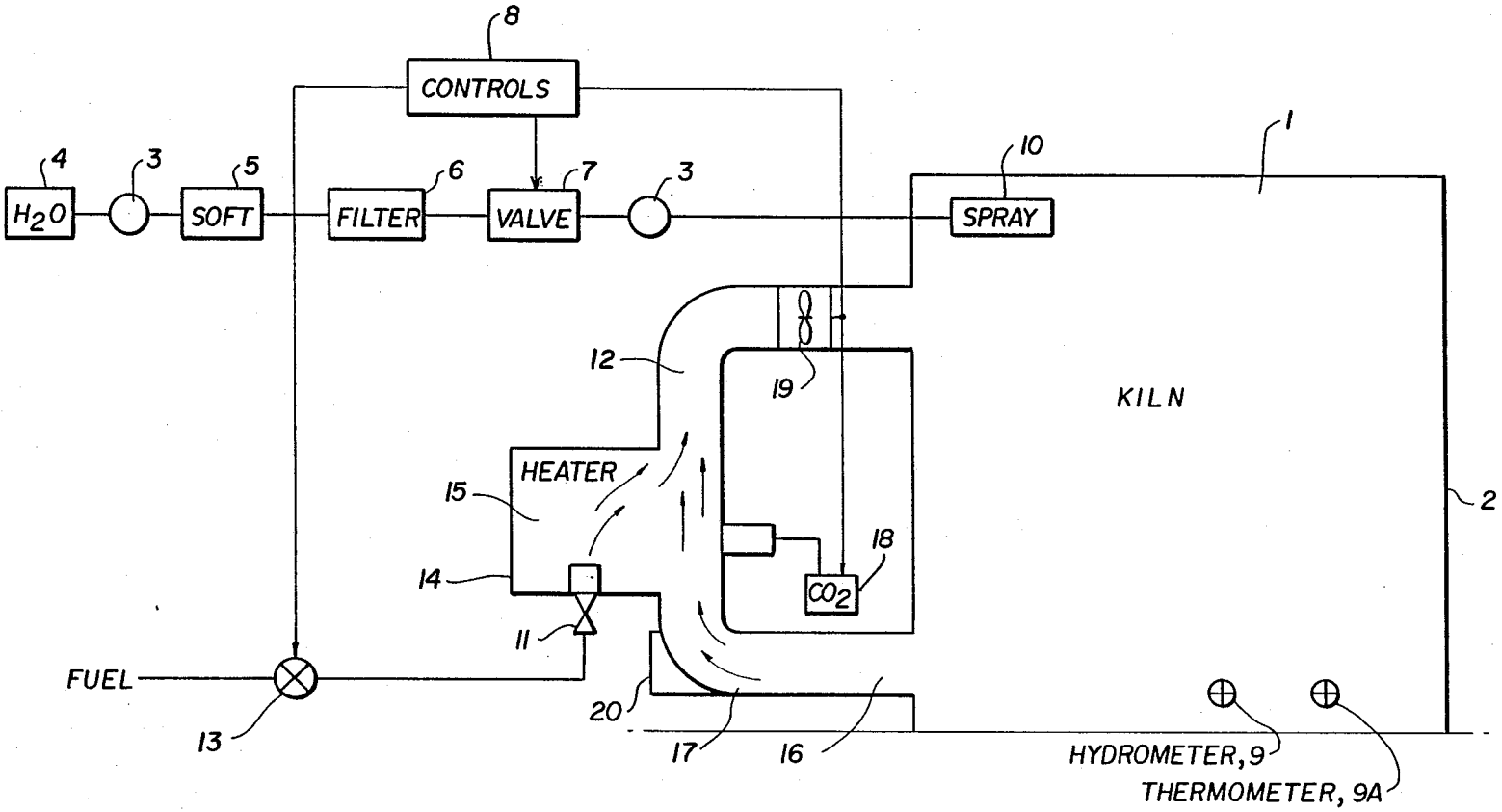
KILN
SPRAY
CONTROLS
VALVE
FILTER
SOFT
$H_2O$
$CO_2$
HEATER
FUEL
HYDROMETER, 9
THERMOMETER, 9A
1
2
3
4
5
6
7
8
10
11
12
13
14
15
16
17
18
19
20

PROCESS OF QUICKLY MANUFACTURING CRITICALLY SHAPED CONCRETE PRODUCTS OF HIGH STRENGTH

This is a continuation-in-part of my copending application Ser. No. 275,199 filed Jun. 19, 1981, abandoned, for "New Procedure to Cure, Carbonate and Dry Concrete".

FIELD OF THE INVENTION

This invention relates to the manufacture of concrete products such as block, pipe and tile, and more particularly it relates to the control of environmental conditions in manufacture of the concrete products to rapidly attain high concrete strength.

BACKGROUND ART

It has been known to those in the concrete arts that the concrete goes through several chemical stages in its curing process before maximum concrete strength is attained.

Thus, during an initial set curing or hardening stage the Portland cement, appropriate inert fillers such as sand or gravel and water are mixed together with the proper proportions to give high strength concrete and proceed in a chemical reaction. This reaction is exothermic giving off internal heat. A 28 day hardening period is common in humid normal temperature ambient atmosphere, lasting until all the water and/or cement is chemically reacted. If there is not enough water some cement is wasted. If there is too much water the concrete strength is reduced. Thus, the amount of water is critical.

One common expedient in the art to aid the initial set curing process is to keep the concrete wet during the initial set stage. This serves two functions, keeping all the water in the mix to be used in the cement-water reaction, and to cool the concrete by evaporation.

It is also a known property of concrete that the chemical reactions in the curing process can be accelerated at higher temperatures. However, the higher temperatures also are critical and tend to cause cracking and deformation of shape during the initial set curing stage.

A residual store of hydrated lime results from this first stage chemical reaction, usually about 30% by weight of the cement. A following strength increasing carbonation stage thus takes place converting the lime, sometimes over several years. The $CO_2$ of the air reacts to form calcium carbonates ($CaCO_3$). In the ambient atmosphere the high strength of the concrete products is not reached quickly. Accordingly, it is known in the prior art to enrich the $CO_2$ atmosphere about concrete articles to accelerate the carbonation stage.

It is an objective of the present invention to provide a manufacturing process for quickly (in a few hours) attaining high strength approaching maximum concrete products of critical shape such as block, tile and pipe.

There is no known satisfactory prior art process for quickly producing high strength concrete products by curing,drying and carbonation stages completed in a few hours.

Other significant and critical problems in the manufacture are also present in any attempt to shortcut the conventional process of atmospheric curing and carbonation, such as the cracking and/or shape distortion of the cement products and the energy efficiency of the manufacturing process.

Thus, other objectives, features and advantages of the invention will be found throughout the following description, drawing and claims.

DISCLOSURE OF THE INVENTION

In order to achieve very high strength of critically shaped concrete products such as blocks, tile and pipe over a very short manufacturing time of a few hours, rather than many weeks, this invention provides for curing, carbonating and drying concrete products in a critically controlled environment system.

Therefore in accordance with this invention, critically shaped cement products are manufactured in apparatus wherein the heat, humidity and $CO_2$ content of the atmosphere is variously regulated during different stages of the manufacturing process. The apparatus comprises (a) an insulated kiln or curing chamber into which the concrete products are processed, (b) a water module located inside the kiln such as a spray, droplets, thin films, capillary water or any other way that when exposed to circulating air or gasses, will cool them by evaporation, and humidifying it, (c) a heating module external to the kiln for circulating hot air through the kiln, (d) a $CO_2$ gas source which may at least in part be the heating module which burns fuel and generates $CO_2$, and (e) controlling means including sensors, valves and controls for fully controlling time duration, temperature, humidity, fuel, and heat (BTU) during each of the stages of the manufacturing process.

Thus, the manufacturing process steps for a typical manufacturing cycle may proceed as follows:

In the initial set stage, the concrete products are formed from plastic mixes of Portland concrete, aggregates, sand, etc. and water and shaped. As quickly as they assume a set that can hold their own shape they are loaded into the cold curing chamber where they will be resident for precise control over several manufacturing stages.

The first hardening step is achieved in one to seven hours. Initially, the exothermal chemical cement-water reaction produces a great amount of heat with resulting water evaporation. This makes the concrete fragile so that any kind of stress, thermal shock, or great loss of water tends to produce cracks or distorted shape and considerably reduces the finally obtainable concrete strength.

Thus, the cooling water stage is regulated by water flow evaporated as a cooling agent into the kiln to be carried by a circulating air stream at a flow rate in response to temperature sensors to prevent too high temperatures to develop and to assure a saturated condition providing just a little more than enough water to keep the air inside the curing chamber saturated thereby to produce a small quantity of free water by condensation until the next stage of the procedure is started.

When the exothermal chemical heat diminishes the next control stage raises the temperature of the concrete at a controlled rate such as 30° per hour until the top temperature is reached by means of circulating hot air through the curing chamber. It is critical as this stage is initiated that the cement be not dehydrated as the higher temperature tends to absorb water withdrawn from the concrete mix. Thus, water is supplied at an increased rate, in the path of the hot dry gasses saturating them so that there is always the proper amount of water in the concrete to react with the cement. This stage rapidly increases the concrete strength and greatly reduces the curing time.

The third control stage keeps the concrete humid at the maximum permissible temperature to continue acceleration of the chemical reaction between cement and water until the cement is substantially all chemically reacted. It is to be recognized that the time for each stage and the maximum temperature, etc. is a variable depending upon the shapes of the cement products (thick or thin), the particular aggregates used and the design specifications for particular types of concrete and concrete products.

The fourth control stage is for carbonation of the free hydrated lime and drying of the concrete and takes place at high temperature in a $CO_2$ atmosphere. Thus, the water is no longer added. The $CO_2$ is obtained from the heater fuel and other sources if necessary. The cured concrete can be brought to very high temperatures if necessary to dry it quickly in humid atmospheres, so that the capillary pores left by the evaporating water are filled with the $CO_2$ atmosphere producing a very deep carbonation by reacting with the hydrated lime liberated by the cement-water reaction.

BRIEF DESCRIPTION OF THE DRAWING

In the single figure of the drawing is shown in block diagram form apparatus for carrying out the various control steps afforded by this invention for fast cure of cement products.

THE PREFERRED EMBODIMENTS

In the drawing, the uncured cement products are placed in the curing chamber or kiln 1 having insulated walls 2 for retaining heat. The atmosphere inside the kiln is controlled in temperature, humidity and $CO_2$ content by the accompanying control system.

Water in reservoir tank 4 used for control of humidity is passed by piping 3 through a softener 5 (if needed), a filter 6, a valve 7 and into the kiln 1 to spray nozzles 10 or other such means that permit an efficient evaporation in the path of the incoming hot air and gases for increasing humidity within the curing chamber 1.

A control system 8 operable in the conventional manner of air conditioning systems from signals such as supplied by hydrometer 9 and thermostat 9A will establish a selected temperature and humidity in the kiln 1, and thus controls the water valve 7, the blowers 19, the $CO_2$ source 18, and the temperature regulating valve 13 for the gas burner 11. The control means also contains appropriate timing means such as a clock for an automated system. The process steps, of course, may be carried out by hand or by a fully automated plant with appropriate limits and conditions set into the control system 8.

The heating module supplies enough heat to increase the temperature inside the kiln 1 at a desired concrete curing control rate, and is preferably heated by an oil or gas burner 11 supplied by fuel through the temperature control valve 13. The heating chamber 14 thus receives the hot combustion gases 15, mainly $CO_2$, which are passed into the kiln 1 by blower 19 along injection duct 12. The blower 19 assures enough air flow speed to form turbulence patterns and equalize temperature inside the kiln and about all the concrete products placed therein. The hot air entering the chamber will become saturated by absorbing water at the spray nozzle 10 and thus preventing the dehydration of the concrete products in the kiln 1.

To supply $CO_2$ used up in curing the concrete products when the fuel burner 11 is not sufficient or when the heater is low or off, the source of $CO_2$ 18 is also supplied with a properly controlled valve or burner control operable by control panel 8.

The hot gases are recirculated through return duct 17. A vent outlet 20 may be opened to clear out the kiln atmosphere, but in the curing process, atmospheric air is never used.

It is therefore seen that the control section 8 by way of semi-manually set or automatically time sequenced controls will operate the kiln through the sequence of procedural steps necessary to quick cure the cement in accordance with the teachings of this invention.

Therefore after shaped concrete products firm enough to place in the kiln curing chamber 1 are in place, the fan 19 circulates air heated by the exothermic chemical reaction of the Portland cement and water and the humidity is kept at saturation by means of hydrometer 9 and thermostat 9A instrument readings and the control of the water spray 10 through valve 7. Also the water spray 10 controls the temperature by cooling the circulating hot air through evaporation and absorption of heat to keep the temperature below that high temperature level which would result in cracking, misshaping or reducing the strength of the concrete product.

As the exothermic heat falls because most of the cement has reacted with the water, as sensed by thermostat 9A, the burner 11 is ignited and the fuel regulated at valve 13 to supply enough BTU, to raise the concrete temperature at a controlled rate of X° per hour until the temperature is at a high but undamaging selected maximum temperature. In particular when the burner is ignited, a surplus of water at spray 10 is discharged in the path of the incoming dry hot gasses to saturate them and prevent the dehydration of the concrete products at a critical time which will seriously reduce concrete strength and result in cracking, etc. of the concrete products. After the warm air is saturated the thermostat 9A and hydrometer 9 supplies information for keeping the water spray 10 flow at the appropriate level for maintaining humidity at the saturation level of the air being circulated through kiln 1.

When the maximum temperature $T_M$ is reached, as noted by thermostat 9A, the heater fuel control valve 13 is manipulated to maintain that temperature for a time period long enough to react substantially all the cement in the concrete products chemically with water. The high temperature accelerates this reaction and up to this time from one to seven hours is required rather than four weeks or so in ambient cure of such products.

During this time the recirculation through pipes 12, 16 has resulted in a substantially saturated $CO_2$ atmosphere because of the burner 11 and exhaust gases 15 introduced into the system. This high $CO_2$ concentration accelerates the carbonation of the free hydrated lime. The circulation of $CO_2$ at a specified temperature then continues after the full conversion of cement without introduction of more water from spray 10 to both carbonate the cement by forming $CaCO_3$ and to obtain a large portion of its ultimate strength within a few hours. When the concrete is cured by the complete chemical conversion of the cement with water, the concrete products will withstand the very high temperatures that enable the acceleration of the carbonation step and the drying of the humid atmosphere to bring the water level in the finished concrete products to the appropriate level. If the burner 11 does not supply enough $CO_2$ to maintain a substantially pure $CO_2$ atmosphere, the auxiliary $CO_2$ source 18 may be activated.

The time for this may be a few hours to bring the entire processing time down to 28 hours or less as compared with many months ambient curing time.

It is evident therefore that applicant has improved the state of the art by providing an improved fast cure manufacturing process for obtaining critically shaped concrete products of high strength approaching maximum within a few hours, without reducing the output concrete product quality by cracks or shape distortions. Accordingly those novel features believed representative of the spirit and nature of the invention are defined with particularity in the appended claims.

I claim:

1. The process of fast-curing concrete products of critical shapes and strength requirements having a Portland cement binding agent that reeacts with water in an exothermal relationship, thereby to provide substantially maximum strength in a few hours manufacturing time without substantial cracking or distortion of shape, comprising the steps of, locating a large number of uncured concrete products in a kiln, and successively treating the products in the kiln by circulating gasses therethrough with a series of curing steps comprising variably controlling the amount of humidity in the kiln to maintain saturation substantially only until substantially all the cement in the concrete chemically reacts with water.

preventing the temperature due to the chemical reaction between cement and water in the concrete products from increasing above a temperature which would result in cracking, misshaping or reducing the strength of the concrete product during an initial set period before enough chemical conversion is achieved, thereby to reduce the temperature rise of the concrete resulting from exothermic cement to water reaction by circulating cooler gasses effected by introduction of water thereinto thereby decreasing temperature and increasing humidity to prevent concrete damage by loss of water during the period when exothermal heating is produced by the water to cement chemical reaction, increasing the temperature of the circulated gasses after the exothermic temperature falls, due to a substantial chemical conversion of cement in the presence of water, at a controlled rate not sufficient to damage the strength or structure of the concrete products up to a predetermined maximum temperature, and maintaining that maximum temperature until substantially all the cement in the concrete chemically reacts with water, adding a controlled amount of just enough cold water to the circulated gasses providing a heated atmosphere within the kiln concurrently with the initiation of the step of increasing the temperature of the circulated gases to produce saturation humidity and thereby prevent dehydration of the products and reduction of damage to the strength of the concrete products by reducing the water available for the cement-water reaction in the concrete product, and drying the products by circulation of said gases with increased temperature and discontinuing addition of water thereby causing a considerable reduction in the water in the products after the cement in the product is substantially all chemically reacted, whereby an energy efficient system is produced.

* * * * *